United States Patent [19]

Hurst, Jr.

[11] Patent Number: 4,567,989

[45] Date of Patent: Feb. 4, 1986

[54] MODULAR STORAGE RACK

[76] Inventor: E. Gerald Hurst, Jr., 4 W. Possum Hollow Rd., Wallingford, Pa. 19086

[21] Appl. No.: 706,108

[22] Filed: Feb. 27, 1985

Related U.S. Application Data

[63] Continuation of Ser. No. 441,220, Nov. 12, 1982.

[51] Int. Cl.[4] ..... A47B 73/00

[52] U.S. Cl. ..... 211/74; 211/194

[58] Field of Search ..... 211/74, 194, 189, 60 R, 211/49 R

[56] References Cited

U.S. PATENT DOCUMENTS

| | | | |
|---|---|---|---|
| 2,149,589 | 3/1939 | Duaei | 211/60 R |
| 3,606,023 | 9/1971 | Edmunds | 211/194 X |
| 4,095,858 | 6/1978 | Hopf | 211/194 X |
| 4,199,070 | 4/1980 | Magnussen, Jr. | 211/189 |
| 4,247,011 | 1/1981 | Walter | 211/194 |

FOREIGN PATENT DOCUMENTS

| | | | |
|---|---|---|---|
| 6875 | 6/1885 | United Kingdom | 211/74 |

*Primary Examiner*—Ramon S. Britts
*Assistant Examiner*—Sarah A. Lechok Eley
*Attorney, Agent, or Firm*—Woodcock Washburn Kurtz Mackiewicz & Norris

[57] ABSTRACT

A modular storage system for the storage of cylindrical objects such as wine bottles or the like is disclosed which features triangular modules which may be attached at their corners to one another to form a storage system. The triangular modules are formed by closely packed arrays of cylindrical tubes, each of which is so sized to hold a single bottle, or other object to be stored. Additional bottles may be stored between adjacent triangular modules, thus substantially increasing the storage capacity of the overall assembly.

9 Claims, 5 Drawing Figures

MODULAR STORAGE RACK

This is a continuation of application Ser. No. 441,220, filed 11/12/82.

FIELD OF THE INVENTION

This invention relates to devices for efficient storage of objects. More particularly, the invention relates to a space-efficient modular storage rack for storing regular cylindrical objects, such as wine bottles, in a horizontal position.

BACKGROUND OF THE INVENTION

It is well known that it is desirable to store wine bottles on their sides, i.e., with their axes horizontal, so that the corks stay wet, thus not permitting spoilage of the wine by overexposure to air. Numerous racks are shown in the prior art which achieve this purpose. However, none of the racks shown by the prior art of which the present inventor is aware, are as efficient as would be desirable both in terms of the space consumed by a rack of given size, and of cost per bottle of storage capacity. Accordingly the present invention seeks to provide a more space efficient, more cost effective apparatus for the storage of wine bottles. For example, the wine storage rack shown in U.S. Pat. No. 3,804,482 to Smith shows diamond shaped storage bins having panels positioned at a 60° angle with respect to the horizontal. As is well known, the 60° included angle means that bottles stacked one on top of another in rows tends to assume a closely packed array, and will fit the most efficiently into the least amount of space. However, the Smith rack is quite complex to manufacture, and has the additional disadvantage that the bottles within each of the bins sit on top of one another, so that if one should desire to remove a bottle from the bottom of the bin, one is obliged to remove most, if not all of the bottles above it. This may be no problem when cases (12 bottles) of the same wine are purchased, but it either wastes space or obliges removal of multiple bottles, when only a few bottles are purchased or remain. Accordingly, it is desirable to provide an individual storage bin for some bottles of wine to be stored so that one can remove a single bottle without having to disturb any others, while preserving the efficiency of the 60° angle. Furthermore, bottles typically vary in size, so that the Smith diamonds must be made oversized, and are consequently not as efficient as would be desirable.

The art is aware of the need for individual bottle storage and a wine rack which addresses it is shown in U.S. Pat. No. 3,746,178 to Wagschal. This patent shows a modular assembly to create a wine rack in which hexagonal end plates are spaced by connecting members. The hexagons interact to form a closely packed array, albeit with some extra spaces because of the extra material between the circular members by which the bottles are located. However, the Wagschal approach is overly complex inasmuch as an individual pair of plastic modules must be assembled for each bottle, which is an annoyance to the consumer and is unduly expensive and complex. Moreover, following the Wagschal approach leaves one with a structure having a base configuration which does not fit flat on, e.g. a floor, so that unless the structure is very heavily built it will not be sufficiently strong to support the weight of a large number of such holders, particularly when wine bottles are inserted therein. Accordingly, it would be desirable to improve the Wagschal approach by providing a stronger modular storage system for cylindrical objects, such as wine bottles, in which the basic module would be of greater capacity than one bottle per module, so as to require minimal assembly, and which would fit flat to the floor.

Another drawback of the Wagschal approach is that only one bottle can be stored in one module. It would be desirable to provide a structure wherein the modules themselves, when assembled, serve to define the space between them into additional storage area in which additional bottles could be efficiently stored so that the cost per bottle is effectively reduced.

A company known as Tedruth Plastics Corporation of Farmingdale, N.J., sells a "Modular Wine and Bottle Rack." This is a modular molded-plastic structure, in which individual bottle storage spaces are provided for up to six bottles. However, despite the hexagonal motif employed, this rack does not achieve the desirable closely-packed array; nor do the modules, when assembled, define additional storage locations.

Another modular approach to storage of wine bottles is shown in U.S. Pat. No. 4,023,681 to Plant in which a box-like structure is subdivided into a plurality of smaller bins by inserting pre-cut pieces of wood. In this way, one need not remove as many bottles to get one which is at the bottom of one of the bins. However, this can still in some cases be an annoyance. Furthermore, the Plant rack does not show utilization of the closely packed stacking feature provided by cylindrical bottles, but instead places the bin walls at 90° which is less space-efficient than the 60° angle shown in, for example, the Smith patent referred to above.

Accordingly, it is shown that the prior art does not satisfy all the needs of the marketplace.

OBJECTS OF THE INVENTION

It is an object of the present invention to provide a wine rack in which the above needs of the art and objects of the invention are satisfied.

In particular, it is an object of the invention to provide a modular wine rack which provides individual storage locations for bottles so that any one can be removed without removing any other ones, but in which the basic module comprises means for storage of a plurality of bottles so that an undue amount of assembly effort is not required by a consumer.

It is a further object of the invention to provide a wine rack in which the cost per bottle stored is substantially reduced over the prior art.

It is a further object of the invention to provide a wine storage rack in which modular subassemblies of individual bottle storage locations once assembled coact with one another to define additional unsubdivided bulk storage area, so that the cost of the rack is amortized over more bottles than are actually contained within each of the individual storage locations whereby the per bottle cost of storage is further reduced.

It is a further object of the invention to provide a modular storage area which can be assembled to fit substantially any irregular shape available for storage, e.g., under a flight of stairs or the like, so that space can be more efficiently utilized in a typical home.

SUMMARY OF THE INVENTION

The above needs of the art and objects of the invention are satisfied by the present invention which comprises a wine storage system made up of a number of modules. Each of the modules is generally triangular in shape, and is assembled from a base and a number of tubes which are stacked in a closely packed triangular array. The tubes are provided with means for retaining them in their relative positions. Means for assembling the modules with other such modules are provided so that any number of the modules desired can be joined. The tubes help bear the weight of the modules above them so that elaborate weight bearing structure is not additionally required. In a particularly preferred embodiment, additional half-modules are provided which allow assembly of a rectangular array where this would be of advantage in fitting the assembled wine rack into a particular space bounded by vertical walls in, for example, a consumer's home.

BRIEF DESCRIPTION OF THE DRAWINGS

The invention will be better understood if reference is made to the accompanying drawings, in which.

DESCRIPTION OF THE PREFERRED EMBODIMENTS

Figure 1:
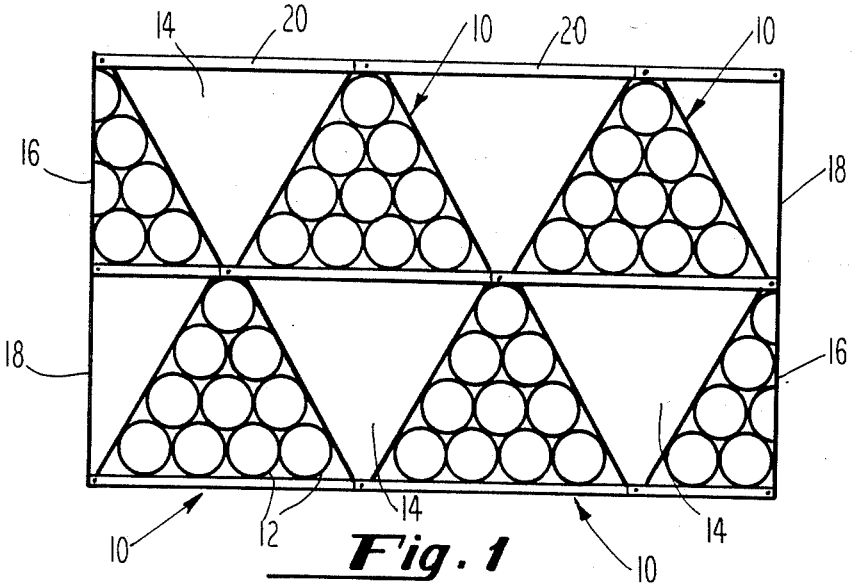
FIG. 1 shows schematically how modules according to the invention may be assembled to form an assembled storage rack.

As discussed above, it is an object of the invention to provide a modular wine storage rack in which individual storage locations are provided for individual bottles so that they can be withdrawn without disturbing others, but it is also desirable that an area be provided for bulk storage, i.e., not being divided into such individual storage locations. This is desirable because frequently, especially in the wine hobbyist marketplace, the enthusiast will own a plurality of individual bottles of varying types, but will also have bought wines in larger lots, such as by the case. Individual bottles are desirably stored in individual storage locations, so that any one can be examined and withdrawn without disturbing others, but the case lots can be stacked one atop another in a storage location not being provided with storage locations for individual bottles, as access to individual bottles is not necessary. FIG. 1 shows how this could be achieved according to the invention. There a plurality of individual modules 10, half modules 16, side panels 18 and top panels 20 are assembled into a generally rectangular array. Each individual module 10 comprises a plurality of tubes 12 which provide individual storage locations for individual bottles; that is, individual bottles can be placed in the tubes 12 and withdrawn without disturbing any others. The interstices between the individual modules 10 as at 14 may also be used for the storage of bottles, but do not provide individual storage locations. Accordingly, these are suitable for the storage of larger quantities of a given wine such as case lots or the like. The assembly shown in FIG. 1 is completed by the addition of half modules 16 which can be used, for example, to complete a rectangular assembly shown in FIG. 1. End plates 18 and top plates 20 complete the assembly. The modular nature of the modules 10 and of the half modules 16 means that the space within which the completed rack fits need not be rectangular but could be quite irregular, such as under a flight of stairs or the like.

Figure 2:
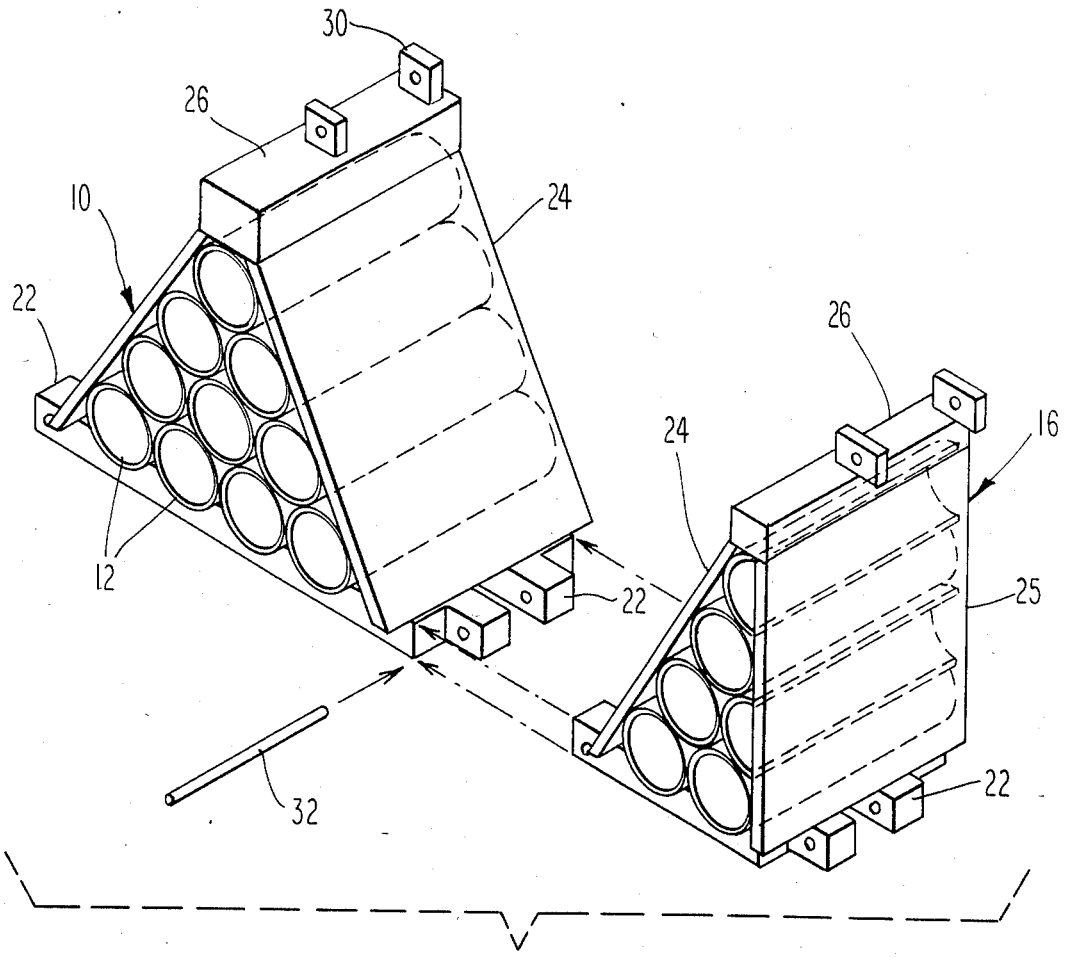
FIG. 2 shows a perspective view of how such modules may be assembled to form the rack shown schematically in FIG. 1.

FIG. 2 shows details of the individual modules 10 and of the half modules 16, and one way in which they may be connected together. The modules 10 and half modules 16 are both assembled upon base members indicated at 22 which, in a preferred embodiment, may comprise a wooden beam such as a two by four, or the like. A plurality of tubes 12 are assembled atop the base beams 22. As is evident from FIG. 2 these are assembled into a closely packed array, i.e., one in which individual tubes of an upper layer fit between the ones of the layer beneath. The angle formed by the axes of the tubes is thus 60°, as is well understood in the art. Side plates such as at 24 are also provided. These serve to constrain the tubes 12 in the proper alignment, even after wine bottles are inserted therein. It will be appreciated that the side plates could be eliminated by, for example, gluing the tubes together, or perhaps bending them with a strapping machine or the like. However, it is believed better for aesthetic reasons to use the plates 24. Moreover, bottles fit the interstices 14 (FIG. 1) better when the side panels 24 are provided. The assembly is completed by a top plate 26 which, like the base beams 22, may be formed of wood. The top plate 26 may be directly in contact with the topmost tube section 12. This structure requires that tubes 12 and side plates 24 be combined to have sufficient strength to support modules attached to the top plate 26, e.g., in the assembly shown in FIG. 1. In this way the side plates 24 need have no large, direct load-bearing function and need only confine the tubes 12 to the proper closely packed array as shown.

As shown in FIG. 2, means are provided on the base plates 22 and on the top boards 26 for attaching the modules 10, the half-modules 16, end plates 18 and top plates 20 together. The exemplary structure shown comprises relatively simple connecting means such as holes drilled in ears formed on the ends of the bottom boards 22 and in tabs 30 attached to the top boards, for insertion of a pin 32 which serves to lock the assembly into a rigid structure; those skilled in the art will recognize that many other expedients are possible.

It will be appreciated, however, that the end plate 25 of the half module 16 must be stronger than the side plates 24 because it must serve to carry some of the weight from the top board 26 to the base board 22. This is because the half triangular structure is not symmetric, so that the weight carried by the additional tubes present in the full triangle must be taken up by the end board 25 of the half module 16. In a successfully tested embodiment of the invention, the tubes 12 were cut from lengths of four inch inside diameter, schedule 80 polyvinylchloride pipe. Such tubes had sufficient strength to permit assembly and full utilization of a two-course rack such as shown in FIG. 1. Much larger assemblies appear feasible.

Figure 3:
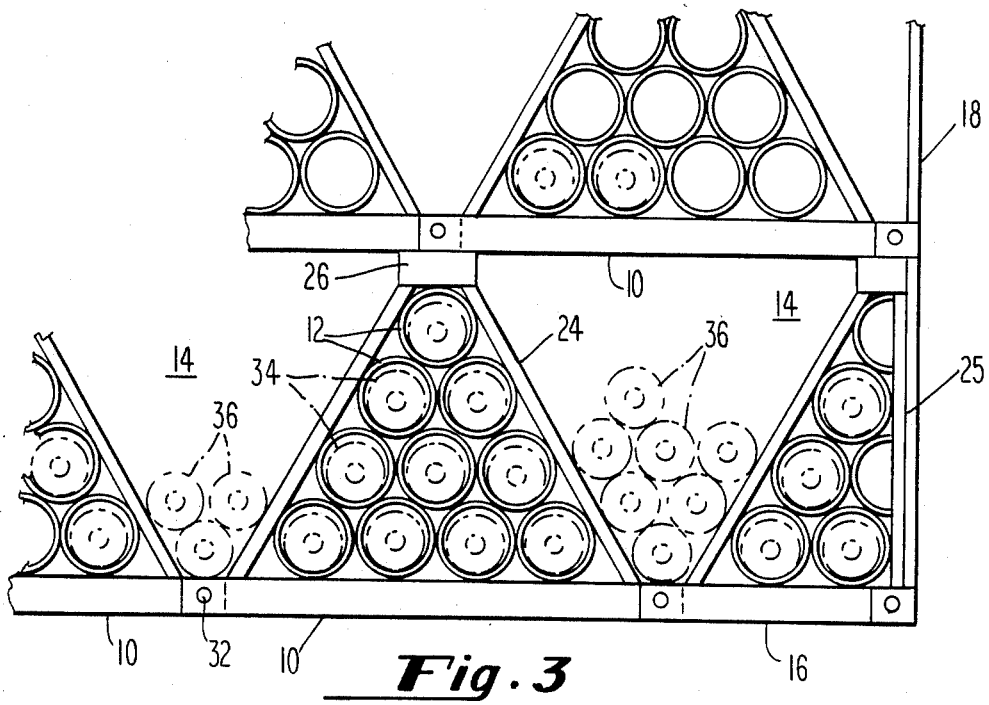
FIG. 3 shows how the interstices between the modules in the assembled rack may also be used to provide addtional storage at no cost.

FIG. 3 shows how modules 10 and half modules 16 can be assembled in further detail than shown in FIG. 1. There a plurality of triangular modules 10 and half-modules 16 are shown pinned together by pins 32. The assembly is completed by, e.g., end plates 18 and top plates not shown. Bottles shown in phantom at 34 are inserted in the individual storage tubes 12. This permits the bottles 34 to be individually withdrawn without disturbing any of the others. Other bottles are also shown in phantom at 36 stored in the interstices 14 formed between two adjacent triangular modules 10 and also between triangular modules 12 and half-modules 16. It will be appreciated that the fact that these are stored between the walls of the adjacent modules 10, or between the modules 10 and half modules 16, which have a 60° included angle, means that these too will form a closely packed array, as shown, thus insuring that the storage continues to be efficient. In the successfully tested embodiment of the invention discussed above, and as shown in the drawings, each of the modules 10 comprises ten of plastic tubes 12. The sizing of these tubes as discussed above was such that 15 bottles 36 could be fitted into the interstices 14. It will be appreciated that this allows an effective 2.5 to 1 increase in the amount of storage available to the user of the storage rack of the invention thus providing a very substantial improvement in the cost per bottle space of storage. Filling in the interstices 14 in this way appears to stabilize the assembly, and by confining the side panels 24 further strengthens the modules.

As shown in FIG. 3, the top board 26 is desirably in direct contact with the uppermost tube 12. This arrangement permits the weight of upper modules 10 to be passed through the top board 26 to the tubes 12, thus permitting the tubes to bear the greater portion of the weight of the upper modules and enabling the construction of the side plates 24 to be comparatively light. This is because the chief function of the side panels 24 is to keep the closely packed array of tubes in its proper configuration, and to provide a smooth surface to the interstices 14, while the tubes 12 substantially bear the weight of the upper modules, allowing lightweight construction of the side panels 24. As shown, the half-module 16 may effectively have a double-thickness side wall 25, by addition of an end plate 18 to insure that this wall bears its share of the load, as discussed above.

Figure 4:
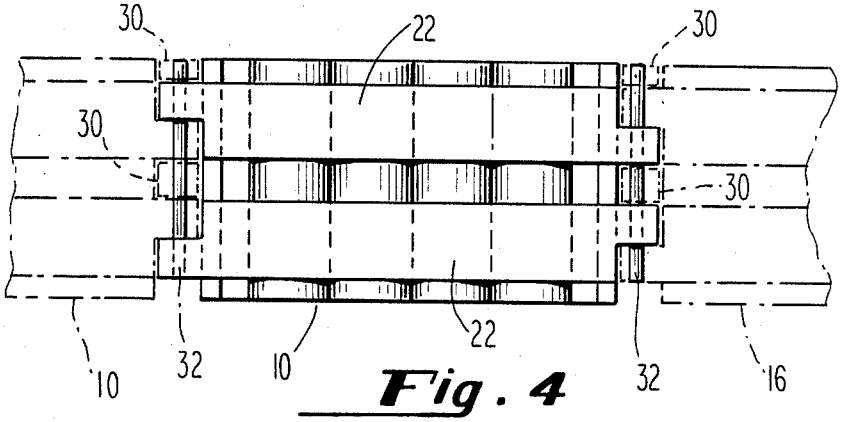
FIG. 4 shows a bottom view of the rack of FIG. 3 showing how individual modules are assembled to one another.

FIG. 4 shows a view from the underside of the second course of the array of FIG. 3 showing how the pins 32 may connect modules 10, half modules 16 and the attaching tabs 30 of a module in a lower course, and how the base boards 22 are notched to provide places for the tabs and pins to be inserted. Those skilled in the art will understand that in the embodiment shown the end pieces 18 and the half modules 16 are not identical depending on whether they go on the left or right end of a module 10. As respects the end joining design, this could be avoided, if desired, by making both of the bottom boards 22 of the module 10 identical, rather than mirror imaged as shown in FIG. 4. Such a construction would be hermaphroditic rather than male/female as presently shown, and would enable the half modules 16 to be identical whether used at the left or right end of a module 10.

Figure 5:
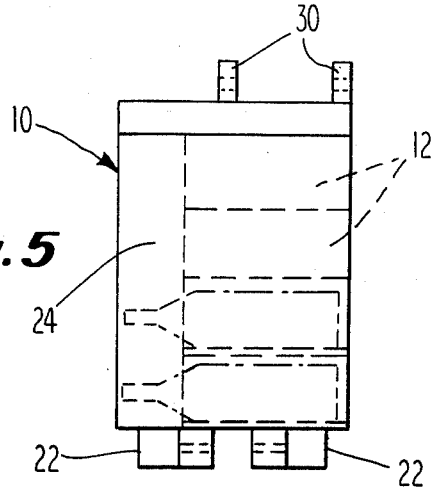
FIG. 5 shows an end view which shows details of the connectors provided for attachment of the modules to one another to form a rack.

FIG. 5 shows an end view of the assembly shown in FIG. 3. There it will be observed that the top attaching tabs 30 are spaced between the ears 32 of the bottom boards 22 so that they can fit therebetween when assembling plural vertically spaced rows or "courses" of modules according to the invention. It is also observed from FIG. 5 that the top board 26 is in direct contact with the uppermost tube 12, again permitting the load to be carried directly by the tubes 12 in addition to the side boards 24. It is also shown in FIG. 5 that the tubes 12 need not extend all the way to the "front" of the assembly. This construction permits easy handling of bottles to be stored, while the "overhanging" side panels protect the necks of the bottles against accidental breakage. This, however, does define a "front" and a "rear" to the modules, so that hermaphroditic design of the modules and half-modules is not possible; hermaphroditic connection of the end panels 18 and top panels 20 would still be desirable, to simplify their manufacture.

Those skilled in the art will recognize that there are numerous modifications and adaptations of the invention which can be made in addition to those specifically mentioned above, for example, the unitary tube sections shown could be made in two parts with space between them, if desired. Innumerable different interconnecting structures are possible. The top boards need not directly contact the topmost tube in each module, as the side panels will carry the load downwardly to the tube array, as long as contact is established between the side walls and the array. Accordingly, the above description of the preferred embodiment of the invention should not be taken as a limitation on its scope, but merely as exemplary thereof; the invention is defined by the following claims.

I claim:

1. A module for use as part of a modular storage unit, for storage of generally cylindrical objects such as wine bottles and the like, such module comprising:

a substantially rigid load-bearing base;

a close-packed triangular array of cylindrical tubes of generally equal length, said tubes being of identical inside and outside diameter, the inside diameter being large enough and the length of the tubes being sufficient to substantially accommodate said cylindrical objects, said tubes being stacked parallel to one another in rows the lowest of which rests on said base, said tubes being made of a material of strength sufficient to enable said array to bear the weight of others of said arrays, having said objects loaded into the tubes;

means to retain said stacked sections of tube in said triangular array; and means at the corners of said triangular array for coupling said module with other like modules, the coupling means at the upper apex of said triangle being mounted to the uppermost one of said tubes to transmit weight thereto.

2. The storage unit of claim 1 wherein said means for coupling plural modules together comprises connecting means on ends of said base, located in juxtaposition to two lower corners of said triangular arrays, for mating with corresponding connecting means on other ones of said modules, and means located directly atop the uppermost of said stacked array of triangular tubes for mating with base members of others of said modules, whereby the weight of said other modules is passed from said means for mating therewith to the topmost of said tubes and thence through the array to the base of said module.

3. The module of claim 2 wherein said connecting means comprises interdigitated lockable members, whereby plural ones of said modules may be locked together.

4. A storage system for the storage of predetermined cylindrical objects, comprising:

a plurality of generally triangular modules and means for attaching said modules to one another at their corners, whereby ones of said modules may be assembled atop pairs of said modules to form a stacked assembly of said modules, each of said modules comprising a plurality of tubes of equal length and diameter, the lengths and the diameters of the tubes being such as to conveniently accommodate said cylindrical objects said tubes being stacked with their axes parallel to one another in a closely packed triangular array, and means to retain said tubes in said array, said tubes having a large enough inside diameter to accommodate said objects and sufficient strength to support a predetermined weight, whereby interstices between the assembled modules provide additional storage space, and wherein said means for attaching ones of said modules to one another transmit load-bearing forces to said tubes.

5. The storage system of claim 4 wherein said first and second connecting means comprise interdigitated, lockable attachment means whereby the storage system may be assembled of said modules locked to one another.

6. A system for the storage of generally cylindrical objects, such as wine bottles, comprising a plurality of substantially identical modules, each module comprising:

a longitudinally extending base member having means at either end for attachment to other substantially identical base members;

a plurality of generally identical cylindrical tubes stacked on said base member in a closely-packed triangular array, the axes of said tubes being generally perpendicular to the direction of elongation of said base member;

means to confine said tubes in said triangular array;

the topmost one of said tubes in each said array being provided with attachment means for load-bearing interaction with the ends of base members of others of said modules; and whereby a plurality of said modules may be assembled above and beside one another into a storage system, the weight of upper ones of said modules in said storage system being borne by the tubes of lower ones of said modules and whereby generally triangular spaces are formed between ones of said modules in any given row of said system for the storage of additional cylindrical objects, not within the individual ones of said tubes, so that the effective storage capacity of the system is multiplied.

7. The system of claim 6 wherein the means for attachment of said modules to one another comprises interdigitated finger means located on the ends of base members and extending upwardly from said attachment member on the topmost of said tubes in each of said arrays, and means whereby said interdigitated finger means can be locked to one another.

8. The system of claim 6 wherein the means for confinement of said tubes in said triangular array comprises side panel means attached at one end to said base and at the other to said attachment member disposed atop the uppermost of said tubes in said triangular array.

9. The system of claim 6 wherein said tubes are disposed in a closely packed array to form said triangular array, whereby the angle of each corner of the triangle thus formed is substantially 60°.

* * * * *